United States Patent [19]

Grogan

[11] Patent Number: 5,072,845

[45] Date of Patent: Dec. 17, 1991

[54] MODULAR CARGO CONTAINER AND A BOTTOM SUPPORT MEMBER THEREFOR

[75] Inventor: Charles W. Grogan, Yardley, Pa.

[73] Assignee: Sea-Land Service, Inc., Iselin, N.J.

[21] Appl. No.: 648,181

[22] Filed: Jan. 31, 1991

[51] Int. Cl.[5] ..... B65D 88/00

[52] U.S. Cl. ..... 220/1.5; 206/511; 206/821; 410/54; 410/77; 410/84; 24/287

[58] Field of Search ..... 220/1.5; 206/511, 512, 206/821; 410/54, 77, 84; 24/287

[56] References Cited

U.S. PATENT DOCUMENTS

| | | | |
|---|---|---|---|
| 3,027,025 | 4/1958 | Tantlinger . | |
| 3,646,609 | 2/1972 | Bodenheimer . | |
| 3,802,357 | 4/1974 | Shahani . | |
| 3,830,381 | 8/1974 | Bodenheimer et al. . | |
| 4,521,941 | 6/1985 | Gerhard . | |
| 4,593,831 | 6/1986 | Clive-Smith . | |
| 4,741,449 | 5/1988 | Bersani | 220/1.5 |
| 4,836,395 | 6/1989 | Goutille | 220/1.5 |
| 4,844,672 | 7/1989 | Yurgevich | 410/54 |
| 4,858,779 | 8/1989 | Zimmerlund | 220/1.5 |
| 4,887,731 | 12/1989 | Pett et al. | 220/1.5 |
| 4,925,349 | 5/1990 | Yurgevich | 410/54 |

*Primary Examiner*—Joseph Man-Fu Moy

*Attorney, Agent, or Firm*—Scully, Scott, Murphy & Presser

[57] ABSTRACT

A modular cargo container having a width greater than the conventional 96 inches, but which can still be used with conventional container handling and locking equipment and apparatus. The container includes a box-shaped body, including a plurality of vertical support posts. A respective one bottom support member is connected to the bottom end of each support post, and a respective one post top member is connected to the top end of each support post. Each bottom support member defines an opening to facilitate handling the cargo container, and the container handling openings defined by laterally opposite bottom support members are spaced apart a distance less than the width of the container, allowing those openings to engage standard container locking and handling equipment. Each of the post top members also defines container handling or locking openings; and these top members are shaped and positioned such that the openings defined by laterally opposite post top members are spaced apart a distance less than the width of the container, allowing those openings to engage standard container locking and handling equipment.

17 Claims, 7 Drawing Sheets

MODULAR CARGO CONTAINER AND A BOTTOM SUPPORT MEMBER THEREFOR

BACKGROUND OF THE INVENTION

This invention generally relates to modular cargo containers, and more specifically to such cargo containers that are adapted to be mounted upon a highway truck-trailer chassis, a railway flat car or the like.

To reduce handling and to expedite loading and unloading operations, cargo is frequently shipped in bulk box-shaped containers that can be transported by and transferred between trucks, railroad cars and ships. For example, cargo may be initially loaded into such a cargo container at a factory, with the container mounted on, or subsequently mounted on, a truck chassis. The container may be carried over highways by the truck, transferred to a railroad car for further transportation, and then transferred back onto a truck, which may carry the container over highways to a final destination such as a warehouse or distribution center. Containers of this type usually are secured to a truck or railroad car frame by locking mechanisms that are mounted on the truck or railroad car frame and that engage complementary receiving mechanisms on the bottoms of the containers.

For many years, U.S. Government regulations limited the width of cargo containers that could be used in inter-state commerce to 96 inches, and cargo containers were commonly constructed with this width. Industry standards, referred to as ISO standards, were established for various dimensions of these cargo containers and for the truck and railroad car frames that were designed to carry these 96 inch wide containers. For example, ISO standards were established relating to the design and placement of the locking mechanisms used to secure the container to truck and railroad car frames, and the vast majority of locking mechanisms were constructed according to these standards.

Recently, U.S. Government regulations were changed to permit containers having widths of 102 inches to be used in inter-state commerce. It would, of course, be highly desirable to construct these new, wider containers so that they may be secured to truck or car railroad frames having locking mechanisms constructed according to conventional ISO standards. Doing this is complicated by several factors, including the design of the containers and the specific design of the conventional locking mechanisms.

To elaborate, these cargo containers—both the new 102 inch wide containers and the standard 96 inch wide containers—usually comprise a box-shaped housing or body having four vertical support posts and four bottom support plates. Each of these vertical support posts is located at a respective one of the corners of the container body, or on a side of the container adjacent a respective one of the container corners, and each bottom support plate is secured to a bottom of a respective one of the vertical support posts of the container. When a container is seated on a supporting member, the bottom support plates may be the principle, if not the only, part of the container that contacts the supporting member. Substantially the entire weight of the container may be transferred downward from its vertical support posts, to the bottom support plates and then to the supporting member; and because of this, the bottom support plates are positioned directly below the vertical support posts of the container. These bottom support plates are also the parts of the container that are directly attached to a supporting member such as a truck or railroad car frame.

More specifically, these containers are locked to a truck frame by locking mechanisms normally comprising a set of twist or lock arms that extend upward from the floor of the truck frame. When a cargo container is placed on such a truck frame, each of these twist arms extends into and is then locked in a bottom opening formed by a respective one of the bottom support plates of the container. Under ISO standards, laterally opposite twist arms on a truck frame are spaced apart approximately 89.5 inches, which is approximately the same distance between the bottom openings of laterally opposite bottom support plates of standard 96 inch wide containers. When standard bottom support plates are used on 102 inch wide containers, however, the bottom openings of laterally opposite bottom support plates are too far apart to receive laterally opposite twist arms of a truck frame that are spaced apart the standard 89.5 inches.

Also, these cargo containers are secured on a railroad car frame by locking mechanisms that often comprise a multitude of pedestals that extend upward from a floor of the frame. When a container is placed on a railroad car frame, each bottom support plate of the container is seated on a respective one of these pedestals. Each of these pedestals, in turn, includes a horizontal support surface, on which a bottom support plate of the container directly seats, and a latch that is inserted into an opening in the side of the bottom support plate. Each of these pedestals further includes a pair of vertical flanges that extend upward from the horizontal support surface of the pedestal; and in use, these vertical flanges extend around and immediately outside of the container corner to hold the container against lateral and longitudinal movement.

For instance, a container may be placed on a railroad car frame with the front right bottom corner and the front left bottom corner, respectively, on first and second laterally opposite pedestals. Each of these pedestals include a front vertical flange that is located immediately forward of the front of the container, and each of these pedestals also includes a side vertical flange that is located immediately outside the right and left sides, respectively, of the container.

According to ISO standards, the side vertical flanges of laterally opposite pedestals are approximately 96 inches apart, so that a cargo container may be located between these side vertical flanges in a close fit therebetween. When conventional bottom support plates are used on 102 inch wide containers, these side vertical flanges prevent laterally opposite bottom support plates of the container from seating directly on the horizontal supporting surfaces of laterally opposite pedestals.

SUMMARY OF THE INVENTION

An object of this invention is to provide a 102 inch wide cargo container that may be secured in a conventional manner to a railroad car or truck frame having locking members designed according to ISO standards to lock to 96 inch wide containers.

Another object of the present invention is to provide a cargo container wider than 96 inches and of the type comprising a box-shaped housing or body having four vertical support posts, with bottom support plates that, on the one hand, extend directly below the vertical supporting posts and will adequately support the full weight of the cargo container, and on the other hand, may be connected to standard locking members designed and located according to ISO standards to lock to 96 inch wide containers.

These and other objects are obtained with a cargo container comprising a body defining the shape of the container and an interior cargo space. The body includes a roof, a floor, front and back walls, left and right side walls, left and right opposite vertical support posts, and left and right opposite bottom support members. The vertical support posts have lateral outside surfaces spaced apart a given distance defining the width of the container, and each bottom support member is connected to a respective one of the vertical support posts. Each bottom support member comprises a central body including at least one outside lateral face defining an opening to facilitate handling the cargo container, a top lateral flange connected to the central body and extending laterally away from that one outside face, and a back lateral flange connected to the central body and also extending laterally away from said one lateral outside face.

In use, each of the vertical support posts is connected to the top lateral flange of a respective one of the bottom support members: and in this way, the central bodies of the opposite bottom support members are spaced inwardly from the lateral outside surfaces of the vertical support posts, and the bottom support members form bottom side recesses extending inward from sides of the container. The container may be wider than 96 inches, while the central bodies of the bottom support members may be used to lock the container in a conventional manner to locking mechanisms designed according to ISO standards for use with 96 inch wide containers.

For example, the central bodies of laterally opposite bottom support members may form bottom openings that are 89.5 inches apart so that the container can be locked to a truck frame having conventional twist arms laterally spaced apart 89.5 inches. In addition, the central bodies of the bottom support members can seat on railway car pedestals adapted, as described above, to support 96 inch wide containers; and in particular, the vertical side flanges of these pedestals can fit in the above-mentioned bottom side recesses formed by the bottom support members of the container so that these flanges do not block the bottom corners of the container from properly seating on the pedestals. At the same time, the bottom support members of the container extend directly below the vertical support posts of the container and are capable of supporting the full weight of the container, as well as a number of like or similar containers stacked thereon.

Further benefits and advantages of the invention will become apparent from a consideration of the following detailed description given with reference to the accompanying drawings, which specify and show preferred embodiments of the invention.

DETAILED DESCRIPTION OF THE PREFERRED EMBODIMENT

Figure 1:
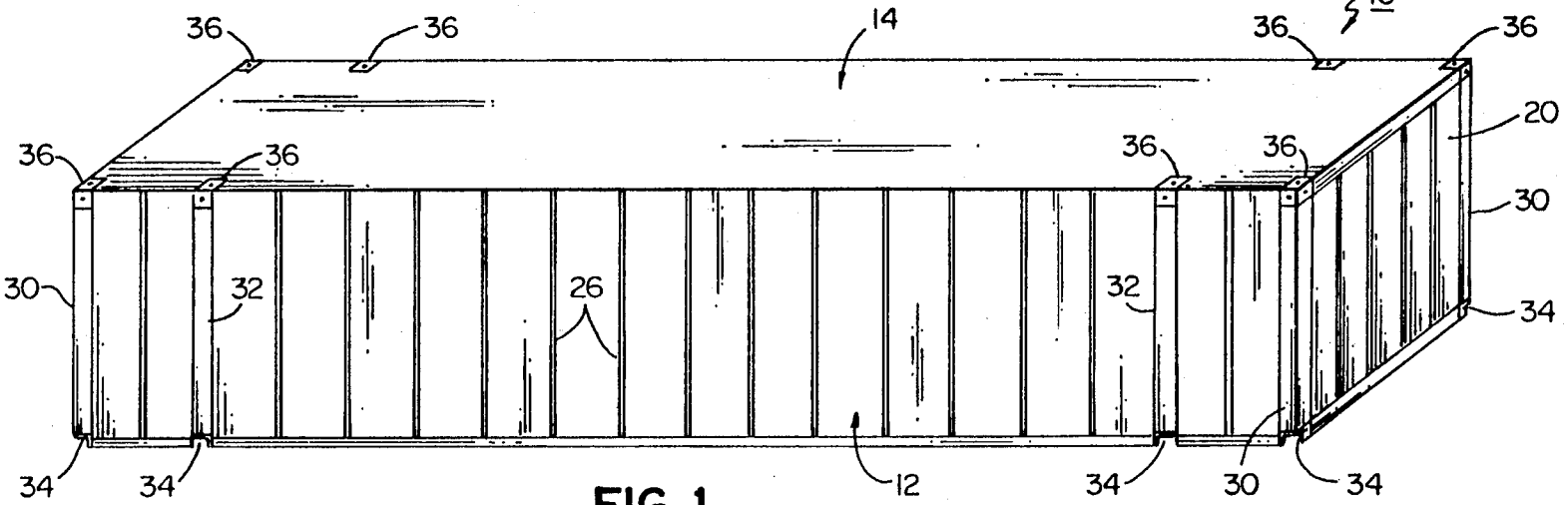
FIG. 1 is a perspective view of a cargo container embodying the present invention.
Figure 2:
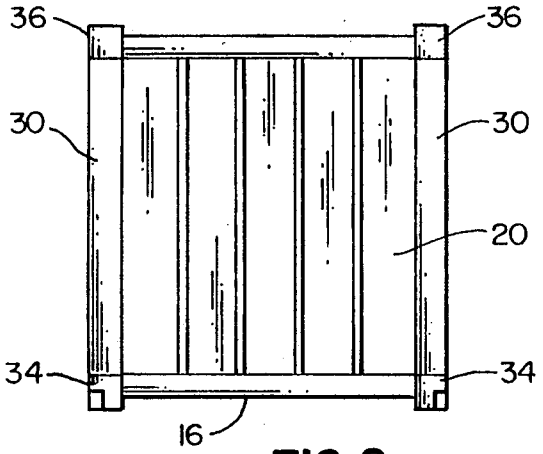
FIG. 2 is a view of the front wall of the cargo container.
Figure 3:
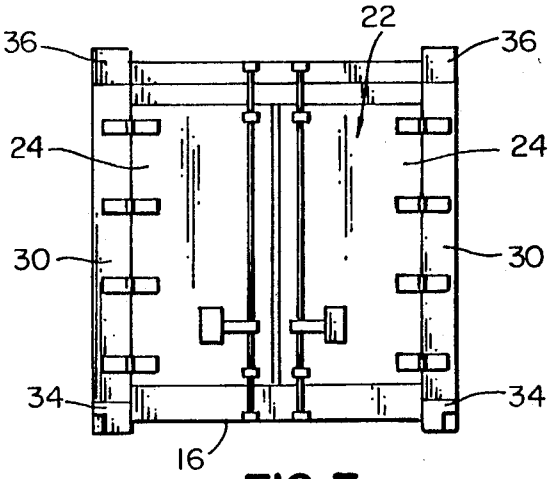
FIG. 3 is a view of the rear wall of the cargo container.

FIGS. 1 through 3 illustrate cargo container 10 comprising a pair of side walls 12, a top cover 14, a floor or bottom wall 16, a front end wall 20, and a rear end wall 22 including a pair of hinged outwardly opening doors 24. The front and side walls of container 10 are preferably formed of sheet metal panels stiffened by vertical ribs 26, but could also be made of plywood, fiber glass or other suitable materials used singly or in combination. While container 10 may be of any width, preferably the container has a width, such as 102 inches, greater than the heretofore common standard width of 96 inches. Also, the container 10 is capable of being detachably secured to a railway flat car or a highway tractor-trailer chassis, and is capable of being hoisted onto a marine vessel where it can be stacked in a column of similar or identical containers, including containers of the standard width of 96 inches.

In order to support the full weight of a plurality of superposed containers and to transmit that load to the support beneath, container 10 is provided with four corner posts 30, four intermediate posts 32 (only two are shown in the drawings), a plurality of bottom support members 34 and a plurality of post top members 36. Corner posts 30 are located at the corners of container 10, and these posts are of conventional construction and of a strength sufficient to support containers thereabove. A front pair of intermediate posts 32 are positioned along the left and right side walls, respectively, of container 10, approximately 4 ft. from the front corner posts of the container; and a back pair of intermediate posts 32 are positioned along the left and right side walls, respectively, of container 10, approximately 4 ft. forward of the back corner posts of the container. Posts 32 also are of conventional construction and are of a strength sufficient to support a plurality of containers thereabove.

Members 34 and 36 are described in detail below. Generally, though, one post top member and one bottom support member is welded to the top and bottom, respectively, of each corner post 30; and, similarly, one post top member and one bottom support member is welded to the top and bottom, respectively, of each intermediate post member 32. Each post top member and each bottom support member is provided with one or more sockets, recesses or openings to receive a container handling, coupling or locking mechanism. All of the support posts 30 and 32 and the members 34 and 36 may be connected at their bottoms, tops or sides by sills or rails, as is usual in container or trailer constructions.

Top post members and bottom support members of containers of the general type described above are often heavy metal castings, and they are commonly referred to as castings or corner castings. As will be understood by those of ordinary skill in the art, the specific manner in which elements 34 and 36 are made is not essential to the practice of the present invention in its broadest sense, and these elements could be metal castings, or they could be made otherwise, as by forging, welded fabrication or in any other suitable way.

Bottom support members 34 of container 10 are very similar to each other, with the principal difference between these members being that the bottom support members on the front half of the container are mirror images of the bottom support members 36 on the back half of the container. Likewise, post top members 36 of container 10 are very similar to each other, and the primary difference between these members is that the post top members on the front of the container also are mirror images of the post top members of the back half of the container. Thus, only one of each of the bottom support members 34 and of the post top members 36 will be described herein in detail.

With reference to FIGS. 4 through 8, each bottom support member comprises central body 40, a top lateral flange 42, a lateral flange 44, and an angular support flange 46. The central body of the support member has the general shape of a hollow parallelpiped, including top, bottom, and four side walls 40*a–f*, respectively. When assembled in container 10, the outside surfaces of at least walls 40*b* and 40*f* face toward the exterior of the container, and at least one, and preferably both, of these surfaces forms a socket, recess or through opening that may be used in a conventional manner to lock the container to a support member such as another container, a truck frame, or a railroad car frame. The through opening in wall 40*f* is referenced in the drawings at 48. A cross web 50 may extend laterally across the interior of the central body 40, from side wall 40*e* to side wall 40*f*, and a through opening 52 may be formed in bottom wall 40*b*, between this cross web and back wall 40*d*, to drain fluids such as water from the space between wall 40*d* and the cross web 50.

Figure 7:
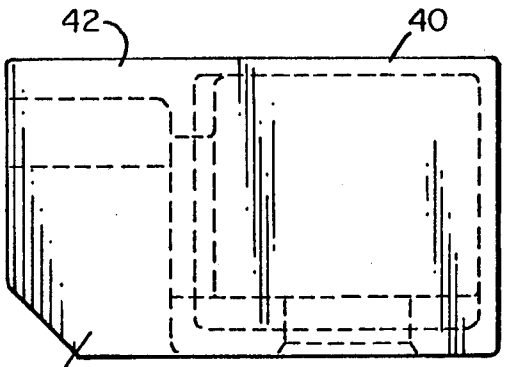
FIGS. 5 through 8 are side, front, back and top views, respectively, of the bottom support member shown in FIG. 4.
Figure 8:
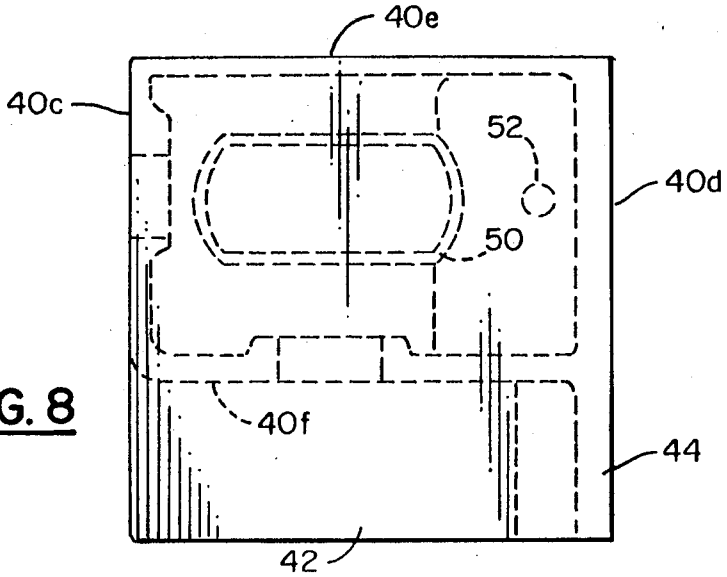
Figure 6:
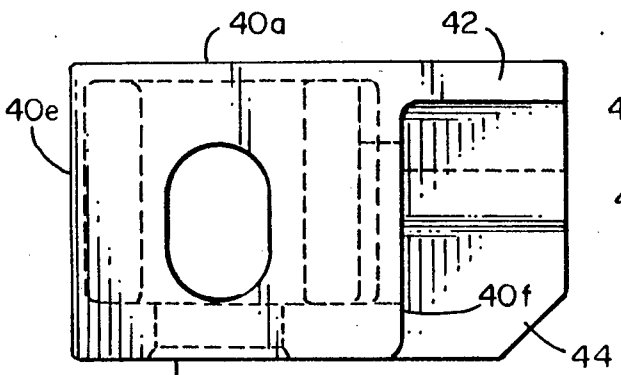

The specific orientation of wall 40*c* relative to wall 40*d* depends on the specific location of bottom support member 34 in container 10. For example, when support member 34 is in the front of container 10, wall 40*c* is forward of wall 40*d*; while when the bottom support member is in the back of the container, wall 40*d* is forward of wall 40*c*. For purposes of consistency, FIG. 6 is considered to be a front view of support member 34, and FIG. 7 is considered to be a back view of the bottom support member. Thus, wall 40*c* is referred to as a front wall, wall 40*d* is referred to as a back wall, and flange 44 is referred to as a back lateral flange.

Top lateral flange 42 is connected to central body 40, above the opening 48 formed in side wall 40*f*, and extends laterally away from the central body; and back lateral flange 44 is connected to central body 40, rearward of opening 48, and also extends laterally away from the central body. As explained in greater detail below, top flange 42 is used to help connect support member 34 to a vertical corner post or intermediate post of container 10, while back flange 44 may be employed to help connect the bottom support member to a longitudinal rail or sill of the container. Preferably, the top surface of top flange 42 is coplanar with the top surface of top wall 40*a* so that these two surfaces form a continuous, planar support for a post of the container. Similarly, preferably, the back surface of back flange 44 is coplanar with the back surface of back wall 40*d* so that these two surfaces form a continuous, planar surface. Moreover, preferably, both flanges 42 and 44 extend away from central body 40, perpendicular to side wall 40*f*.

Figure 4:
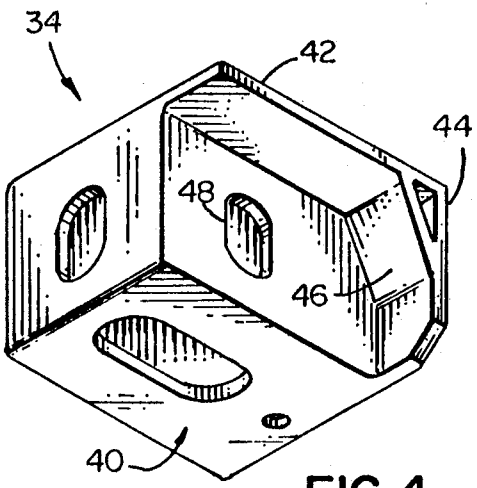
FIG. 4 is an orthogonal view of one of the bottom support members of the cargo container.
Figure 5:
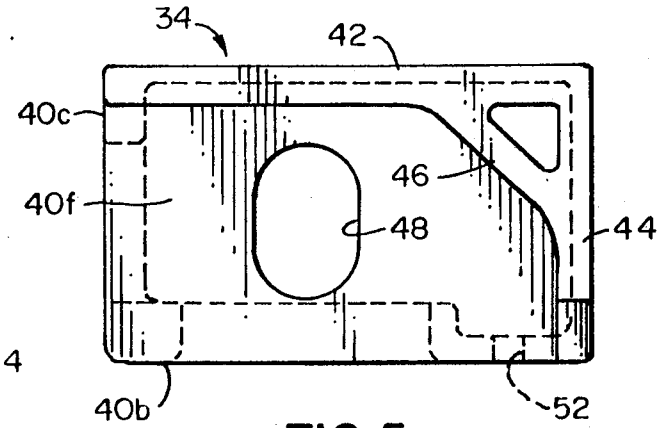

Angular support flange 46 is connected to and extends between top flange 42 and back flange 44 to help support the top flange. As best shown in FIGS. 4 and 5, angular flange 46 is connected to a rearward portion of top flange 42 and extends rearwardly downwardly to an intermediate portion of back flange 44. Angular flange 46 may be connected to top and back flanges 42 and 44 at other locations, however; and, for example, angular support flange 46 may be connected to top flange 42 at a position forward of the location at which the support flange is connected to the top flange in FIG. 5. Preferably, though, angular support flange 46 is positioned so that it does not significantly interfere with movement of a conventional or standard locking mechanism into opening 48. In addition, preferably, support flange 46 is also connected to central body 40 and extends laterally outwardly therefrom, perpendicular to side wall 40*f*.

Member 34 may be made in any suitable manner, although preferably it is formed as a one-piece steel casting so that top, back and angular flanges 42, 44 and 46, and central body 40 are all integrally connected together. Alternatively, for example, one or more of the top, back and angular support flanges 42, 44 and 46 may be formed separately from central body 40 and subsequently welded thereto.

Figure 9:
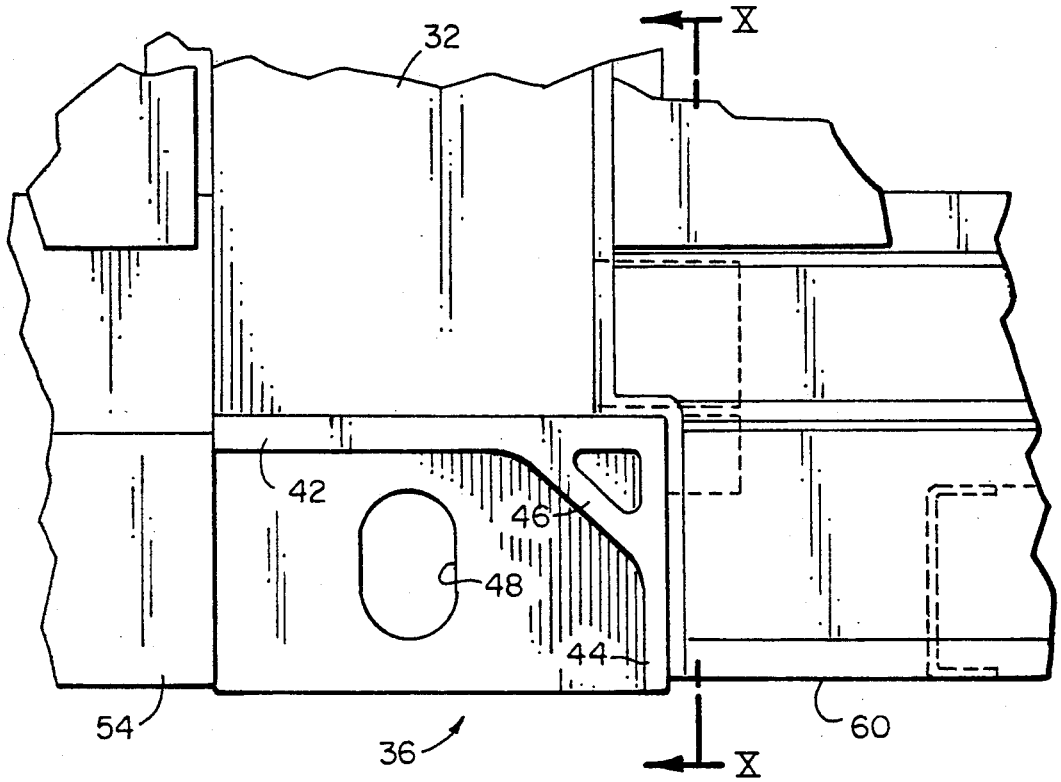
FIG. 9 shows a lower front portion of the cargo container of FIG. 1, and in particular, shows the bottom support member of FIGS. 4 through 8 connected in place in the cargo container.
Figure 10:
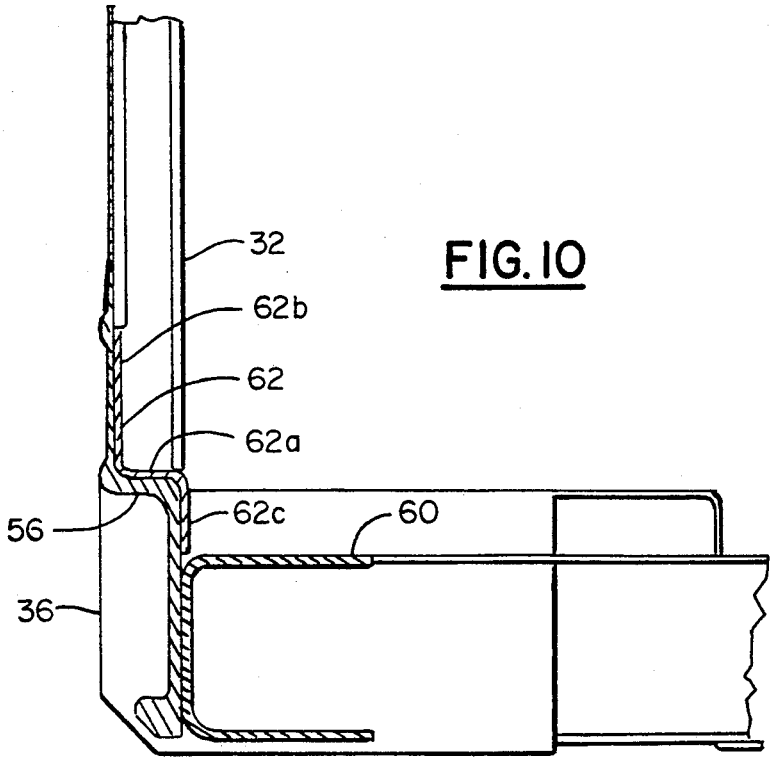
FIG. 10 is a cross sectional view taken along Line X—X of FIG. 9.
Figure 14:
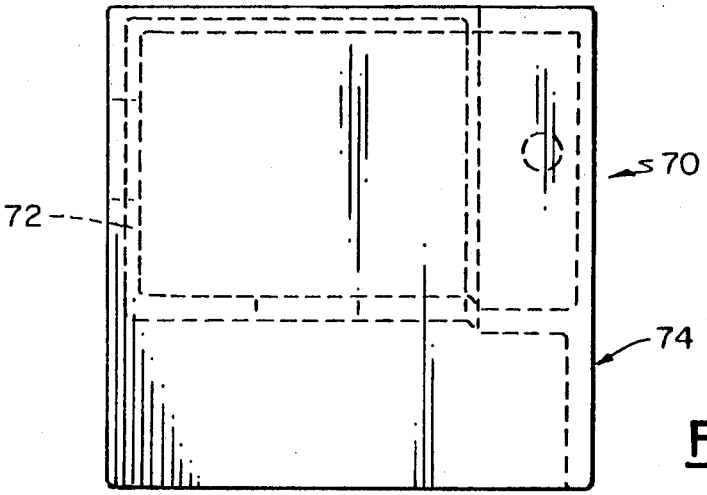
FIGS. 11–14 are side, front, back and top views, respectively, of an alternate bottom support member that may be used in the container of FIGS. 1–3.
Figure 13:
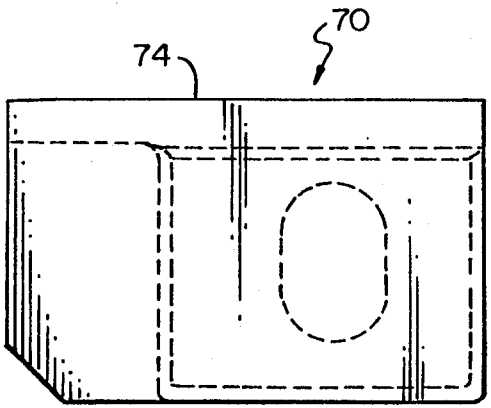
Figure 11:
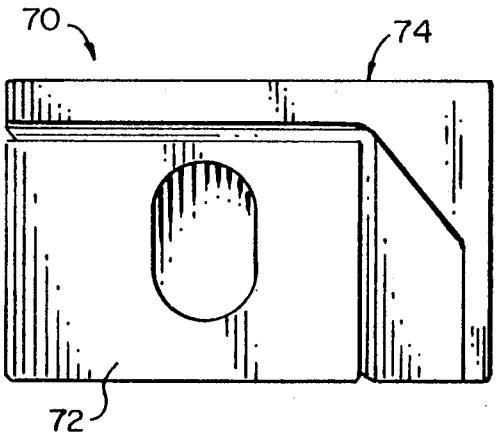

FIGS. 9 and 10 show one bottom support member 34 connected in place in container 10, and more specifically, the bottom of intermediate support post 32 is securely connected to the top surface of top flange 42, a first longitudinal rail 54 is connected to the front wall of member 34, and a second longitudinal rail 56 is connected to a back side of member 34. Preferably, post 32 and first longitudinal rail 54 are directly connected to member 34; however, second longitudinal rail 56 is connected to member 34 via a connecting channel 60 that itself is directly connected to the back side of member 34. The various connections between post 32, rail 54, channel 60 and member 32 may be made in any suitable manner, although preferably these parts are welded together. In addition, longitudinal rail 56 may be connected to channel 60 in any suitable way, however preferably the rail is riveted to this channel.

As illustrated in FIGS. 9 and 10, an intermediate member 62 may be used to help connect channel 60 to bottom support member 34. This intermediate connecting member includes a horizontal portion 62*a*, and upper and lower vertical portions 62*b* and *c* that extend upward and downward, respectively, from horizontal portion 62*a*. Horizontal portion 62*a* seats on and is securely connected to a rearward portion of top flange 42, upper vertical portion 62*b* seats against and is securely connected to a first vertical surface of channel member 60, and lower vertical portion 62*c* seats against and is securely connected to a second vertical surface of that channel member. Preferably, horizontal portion 62*a* of connecting member 62 also extends rearwardly of member 34 and seats on and is welded to a horizontal portion of the channel member 60. The connections between intermediate member 62, bottom support member 34 and connecting channel 60 may be made in any suitable way, although welding is preferred.

As will be understood, bottom support member 34 may be connected to a corner post of container 10 in a very similar manner, although in such a case, it would not be necessary to connect the bottom support member to a second longitudinal rail.

FIGS. 11–14 show an alternate bottom support member 70 comprising a conventional bottom support member 72 and an adapter 74, which is shown by itself in FIGS. 15–18. With reference to FIGS. 15–18, adapter 74 comprises parallel, top outside and inside plates 76 and 80, and parallel back outside and inside plates 82 and 84. The back edge of top plate 76 is connected to the top edge of back plate 82, and these two plates are perpendicular to each other. Likewise, the back edge of top plate 80 is connected to the top edge of back plate 84, and these two plates are perpendicular to each other. Front edges of plates 76 and 80 are connected together by connecting portion 86, and bottom edges of plates 82 and 84 are connected together by connecting portion 90. Preferably, a vertical supporting flange portion 92 extends between lateral edges of plates 76 and 82.

Adapter 74 may be made in any suitable manner. Preferably, plates 76 and 82 and connecting portions 86 and 0 are formed as a first one-piece steel casting, plates 80 and 84 are formed as a second one-piece steel castings, and then these two castings are welded together to make member 74. A through opening 94 is made in connecting portion 90 to drain any fluids that may collect inside adapter 74.

Figure 12:
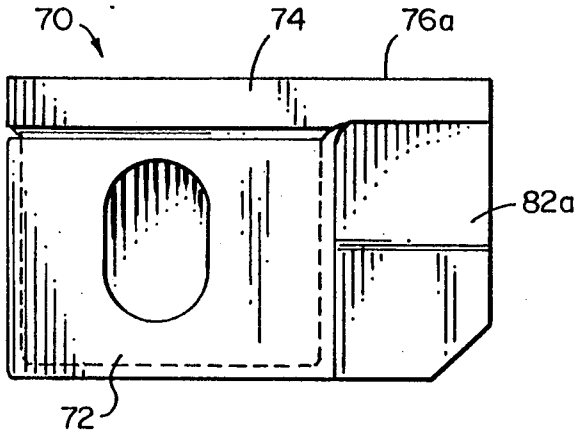
Figure 18:
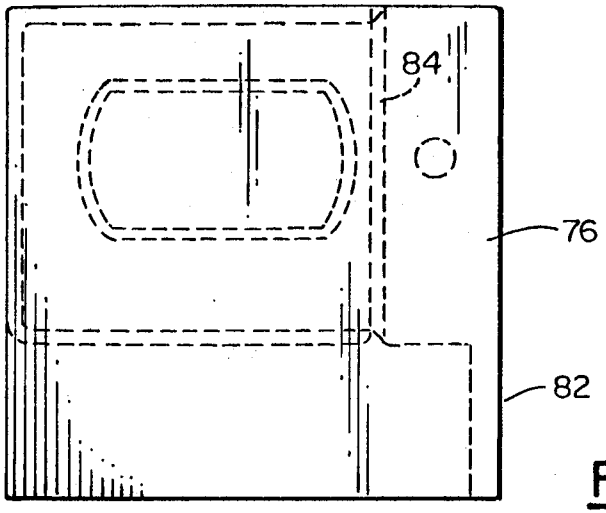
FIGS. 15–18 are side, front, back and top views, respectively, of one part of the bottom support member of FIGS. 11–14.
Figure 17:
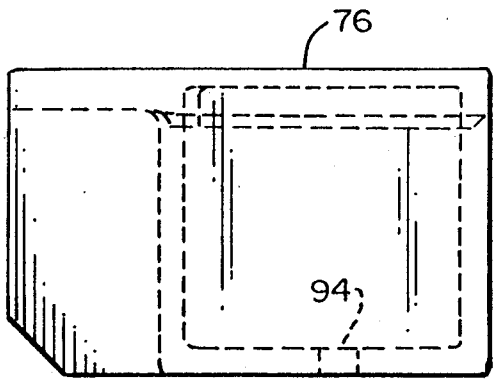
Figure 15:
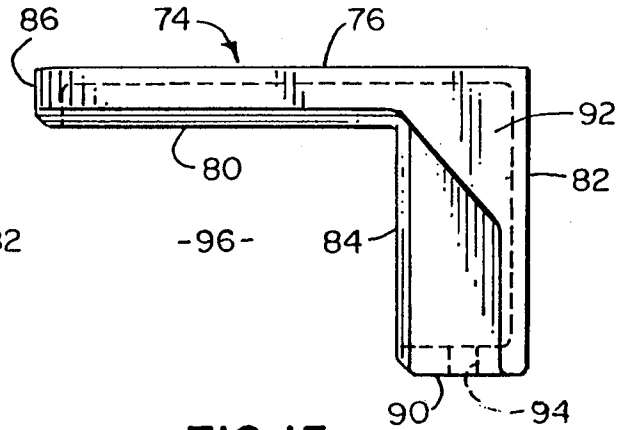
Figure 16:
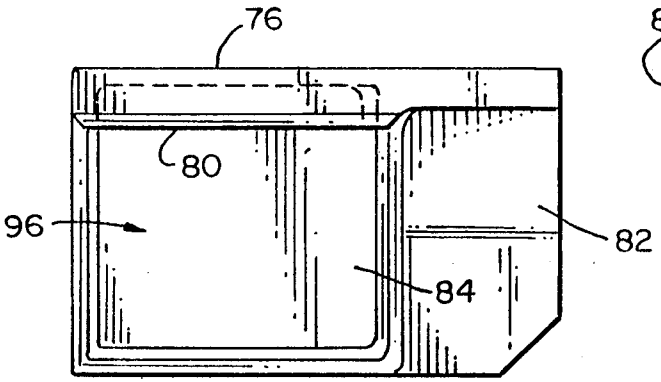
Figure 19:
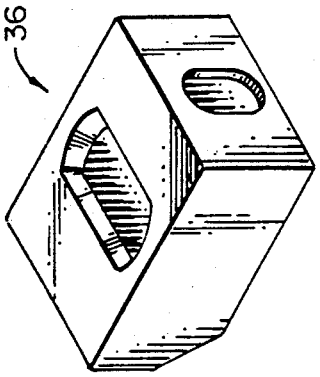
FIG. 19 is an orthogonal view of one of the post top members of the cargo container shown in FIG. 1.
Figure 22:
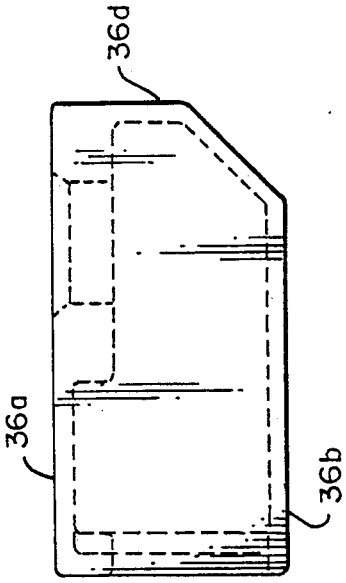
FIGS. 20 through 23 are front, left side, right side and top views, respectively, of the post top member shown in FIG. 19.
Figure 23:
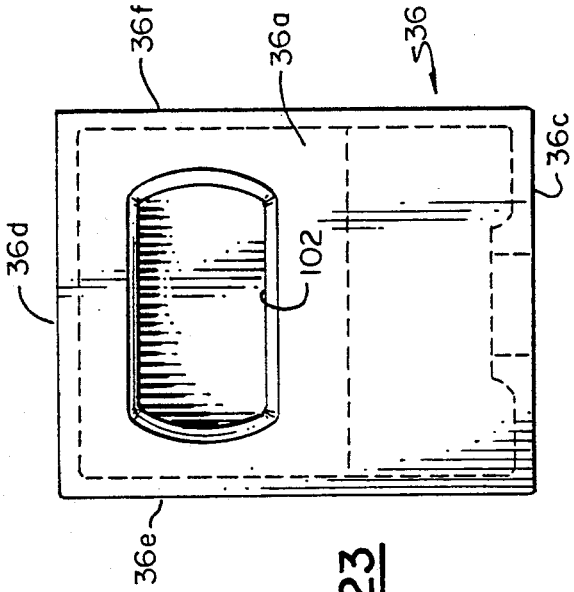

With particular reference to FIG. 15, adaptor 4, specifically plates 80 and 84, form a right angle recess 6. Support member 70 is formed by securing the conventional support member 72 in recess 96; and this may be done by welding member 72 to plates 80 and 84, or in any other suitable manner. Support member 72 itself preferably comprises a hollow parallelpiped forming at least a plurality of openings to connect support member 70 to conventional container handling or locking equipment. With particular reference now to FIG. 12, adapter 74, specifically plates 76 and 82, extends laterally outside of member 72, forming a top lateral flange portion 76*a* and a back lateral flange portion 82*a*.

Support member 70 may be secured in container 10 in a manner identical or analogous to the way in which support member 34 is secured in the container. Specifically, a bottom of a vertical support post of container 10 is connected to top lateral flange portion 76*a*, a longitudinal rail or sill of the container is connected to back plate 82, and another longitudinal rail or sill of the container is connected to a front surface of member 72.

FIGS. 19 through 23 show one of the post top members 36, which generally comprises a hollow parallelpiped with one truncated edge. More specifically, post top member 36 comprises top, bottom, and four side wall members 36*a–f*, respectively. Top and bottom wall members 36*a* and *b* are parallel to each other and are connected together by side walls 36*e* and *f*, which themselves are parallel to each other. Wall member 36*c* is connected to and extends between top, bottom and side wall members 36*a, b, e,* and *f*, perpendicular to each of those wall members. Wall member 36*d* includes top and bottom portions; and this top portion is connected to and extends downward from top wall 36*a*, perpendicular thereto, and this bottom portion extends downwardly forwardly from the top portion of wall member 36*d* to the bottom wall member 36*b*.

Figure 20:
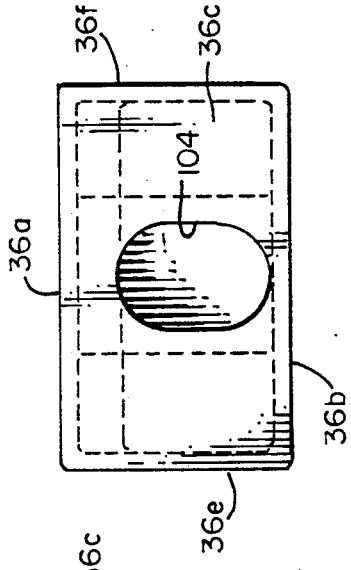
Figure 21:
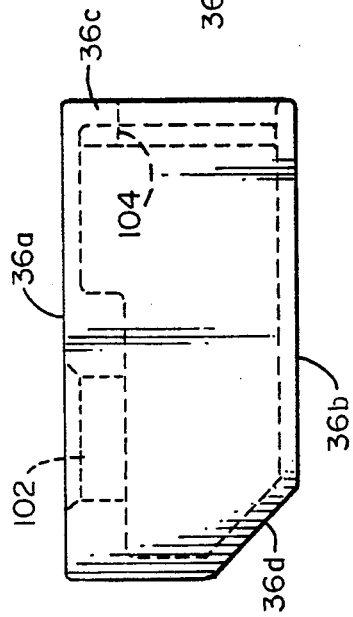

As with the front and back walls of support member 34, the specific orientation of wall 36*c* relative to wall 36*d* depends on the specific location of post top member 36 in container 10. When member 36 is in the front of container 10, wall 36*c* is forward of wall 36*d*; and when the post top member is in the back of the container, wall 36*d* is forward of wall 36*c*. For purposes of consistency, FIGS. 20 is considered to be a front view of member 36, and walls 36*c* and *d* are referred to as front and back walls respectively.

When assembled in container 10, outside surfaces of walls 36*a* and *c* face toward the exterior of the container, and at least one of these surfaces forms a socket, recess or opening to receive a conventional container locking or handling member. With the embodiment of post top member 36 shown in FIGS. 19–23, such a receiving opening 102 is formed in top wall 36*a*. A second opening 104 is formed in front wall 36*c* to drain fluids from inside the post top member.

As with bottom support member 34, top post member 36 may be constructed by any acceptable technique, however preferably this member also is formed as a one-piece steel casting, with walls 36*a–f* integrally connected together.

Figure 24:
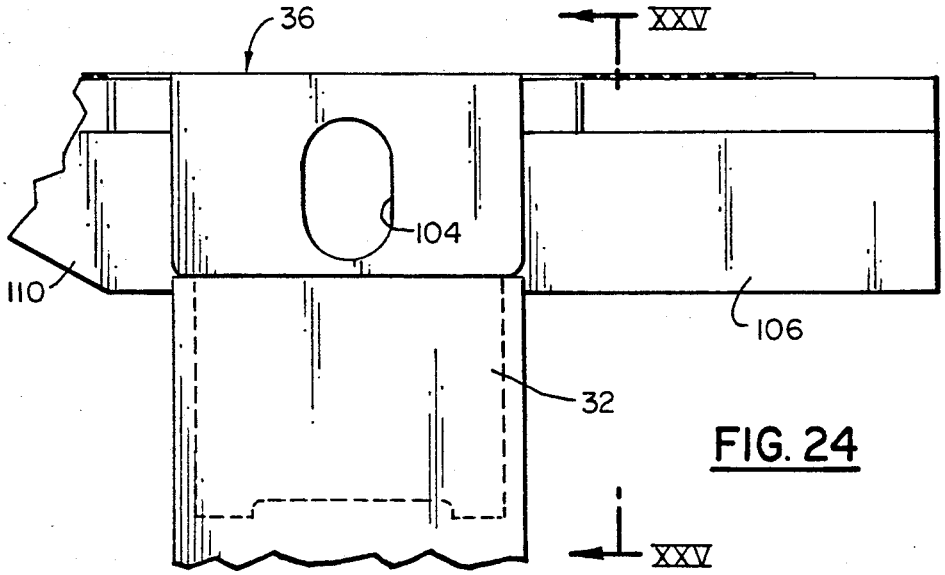
FIG. 24 shows an upper front portion of the cargo container of FIG. 1, and in particular, shows the post top member of FIGS. 19 through 23 connected in place in the cargo container.
Figure 25:
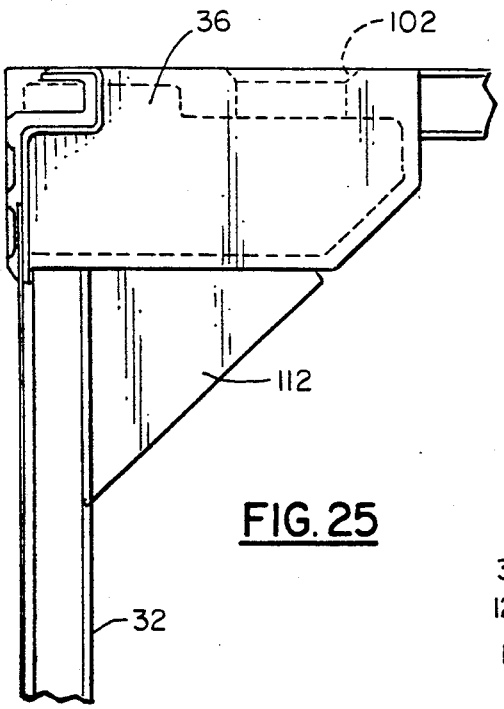
FIG. 25 is a cross sectional view taken along Line XXV—XXV of FIG. 24.

FIGS. 24 and 25 show one post top member 36 connected in place in container 10. In particular, the top of intermediate support post 32 is connected to the bottom of member 36, and first and second longitudinal rails 106 and 110 of container 10 are connected, respectively, to first and second sides of member 36. Preferably, all of these connections are made by welding, although any other suitable technique may be used. A triangular shaped brace member 112 may be connected to intermediate post 32 and the bottom wall of member 36 to help support that member.

The truncated back edge of post top member 36 in combination with a smaller than conventional triangular brace member 112, substantially reduces the extent to which member 36 and brace 112 extend into the interior of container 10, and this substantially increases the effective cargo space therein. Moreover, this is done while still providing the 0 desired complete support for post top member 36 and while positioning opening 102 thereof an appreciable distance inward from the adjacent side of container 10. This, in turn, is of utility because, with reference to FIG. 1, when two such top post members 36 are located directly opposite each other, on opposite sides of container 10, the container may be handled by conventional handing equipment despite the greater than conventional width of the container.

A post top member 36 may be connected to a corner post 30 of container 10 in a very similar manner, however in such case, it would not be necessary to connect the post top member to two longitudinal rails.

Figure 26:
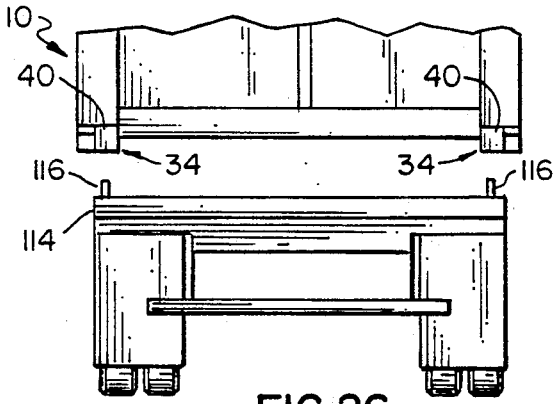
FIG. 26 shows how the cargo container of FIG. 1 may be mounted on a truck chassis having conventional locking members positioned for use with a narrower container.

FIG. 26 illustrates how the container 10 of the present invention may be carried by a conventional truck chassis 114 having conventional container locking members 116 positioned for use with 96 inch wide containers. Because the central bodies 40 of bottom support members 34 shown in FIG. 26 are spaced inwardly from the container sides, these bottom support members can engage locking members 116, even though the side walls of the container themselves are more than 96 inches apart. Moreover, because of the unique construction of bottom support members 34, these members still are capable of supporting the full load of container 10, as well as a number of like or similar containers stacked thereon.

Figure 27:
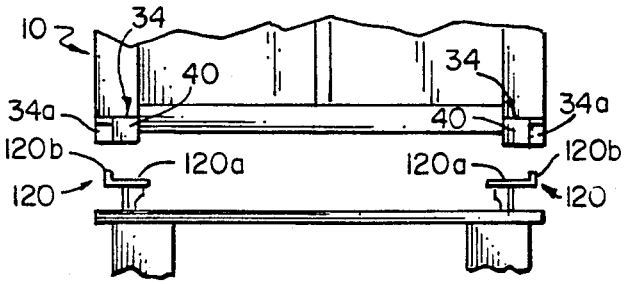
FIG. 27 shows how the cargo container of FIG. 1 may be mounted on a railway car frame having conventional mounting pedestals positioned for use with a narrower container.

FIG. 27 illustrates how one end of container 10 may be seated on two railway car pedestals 120 positioned according to ISO standards to receive a standard 96 inch wide container. Because central bodies 40 of bottom support members 34 are spaced laterally inward from the sides of container 10, those central bodies can seat on horizontal support surfaces 120*a* of pedestals 120. Vertical side flanges 120*b* of pedestals 120, which limit lateral movement of container 10, are received in bottom side recessed 34*a* formed in bottom support members 34, and hence these vertical flanges do not block the container bottom from seating horizontally on the pedestal support surfaces 120*a*.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. A cargo container, comprising a body defining the shape of the container and an interior cargo space, the body including a roof, a floor, front and back walls, left and right side walls, left and right opposite vertical support posts, and left and right opposite bottom support members, wherein the vertical support posts have lateral outside surfaces spaced apart a given distance defining the width of the container, and each bottom support member is connected to a respective one of the vertical support posts, and comprises:

a central body including a lateral outside face defining an opening to facilitate handling the cargo container;

a top lateral flange connected to the central body and extending laterally away from said one outside face, the top lateral flange being connected to and supporting said respective one of the vertical support posts; and a back lateral flange connected to the central body and extending laterally away from said one lateral outside face;

wherein said openings of the lateral outside faces of the central bodies of the bottom support members are laterally spaced apart less than the width of the container.

2. A cargo container according to claim 1, wherein each bottom support member further includes an angular support flange connected to and extending between the top lateral flange and the back lateral flange to help support said top lateral flange.

3. A cargo container according to claim 2, wherein the angular support flange is connected to the top lateral flange rearward of the opening defined by said lateral face of the central body.

4. A cargo container according to claim 3, wherein the top lateral flange and the back lateral flange are connected to said lateral face of the central body.

5. A cargo container according to claim 4, wherein:

the central body further includes a top planar face and a back planar face;

the top lateral flange defines a top face coplanar with the top face of the central body; and the back lateral flange defines a back face coplanar with the back face of the central body.

6. A cargo container according to claim 5, wherein the central body, the top lateral flange, the back lateral flange, and the angular support flange are integrally formed together.

7. A cargo container according to claim 6, wherein the top lateral flange, the back lateral flange and the angular support flange extend perpendicular to said lateral outside face of the central body.

8. A cargo container according to claim 7, wherein the central body is a hollow parallelpiped.

9. A cargo container according to claim 1, wherein:

the body of the container further includes left top members connected to the left and right support posts, respectively; and each of the post top members including a body having a truncated lower corner facing said interior cargo space.

10. A cargo container according to claim 9, wherein:

the body of the container further includes left and right triangular brace members;

the left triangular brace member is connected to and extends between the left support post and the left post top member;

the right triangular brace member is connected to and extends between the right support post and the right post top member;

the truncated corner of the right post top member defines a first angular plane, and the truncated corner of the left post top member defines a second angular plane;

the right triangular brace member is substantially completely within an area bounded by the right support post, the right post top member and the first angular plane; and the left triangular brace member is substantially completely within an area bounded by the left support post, the left post top member and the second angular plane.

11. A cargo container according to claim 10, wherein:

each of the triangular brace members has a laterally inside base edge;

the base edge of the right triangular brace member is aligned with the first angular plane; and the base edge of the left triangular brace member is aligned with the second angular plane.

12. A support member for a modular, stackable cargo container of the type having a body defining the shape of the container and an interior cargo space, the support member comprising:

a central body including at least one outside face defining an opening to facilitate handling the cargo container;

a top lateral flange connected to the central body and extending laterally away from said one outside face, for connecting the support member to the body of the container;

a back lateral flange connected to the central body and extending laterally away from said one outside face, to further connect the support member to the container body; and an angular support flange connected to and extending between the top lateral flange and the back lateral flange to support said top lateral flange, said angular support flange being connected to the top lateral flange rearward of the opening defined by said one face of the central body.

13. A support member according to claim 12, wherein:

the top lateral flange, the back lateral flange, and the angular flange are connected to and laterally extend perpendicular to said one outside face of the central body;

the central body further includes a top planar face and a back planar face;

the top lateral flange defines a top face coplanar with the top face of the central body;

the back lateral flange defines a back face coplanar with the back face of the central body.

14. A support member according to claim 13, wherein the central body, the top lateral flange, the back lateral flange and the angular support flange are integrally formed together.

15. A support member for a modular, stackable cargo container, comprising:

an adapter part having planar top and back surfaces, and forming a recess; and a central part secured in said recess and having a lateral face;

the top surface of the adapter part including a top flange portion laterally extending beyond the central part;

the back surface of the adapter part including a back flange portion laterally extending beyond the central part.

16. A support member according to claim 15, wherein:

the adapter part includes top and back outside plates, and top and back inside plates;

the top planar surface is formed by the top outside plate;

the back planar surface is formed by the back outside plate;

the recess is formed by the top and back inside plates.

17. A support member according to claim 16, wherein:

the central part includes planar top and back surfaces;

the top surface of the central part is parallel to and held against the top inside plate of the adapter part; and the back surface of the central part is parallel to and held against the back inside plate of the adapter part.

* * * * *

UNITED STATES PATENT AND TRADEMARK OFFICE

CERTIFICATE OF CORRECTION

PATENT NO. : 5,072,845

DATED : December 17, 1991

INVENTOR(S) : Charles W. Grogan

It is certified that error appears in the above-identified patent and that said Letters Patent is hereby corrected as shown below:

Column 7, line 44: "0" should read as --90--

Column 7, line 50: "4" should read as --74--

Column 7, line 51: "6" should read as --96--

Column 8, line 60: delete "0"

Column 10, line 28, Claim 9: "left top" should read as --left and right post top--

Signed and Sealed this

Twenty-second Day of June, 1993

*Attest:*

Michael K. Kirk

MICHAEL K. KIRK

*Attesting Officer*

*Acting Commissioner of Patents and Trademarks*